US007462986B2

(12) United States Patent
Woo

(10) Patent No.: US 7,462,986 B2
(45) Date of Patent: Dec. 9, 2008

(54) PLASMA DISPLAY PANEL WITH GAS EXHAUST PORT

(75) Inventor: Seok-Gyun Woo, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 303 days.

(21) Appl. No.: 11/180,109

(22) Filed: Jul. 12, 2005

(65) Prior Publication Data

US 2006/0061276 A1 Mar. 23, 2006

(30) Foreign Application Priority Data

Sep. 21, 2004 (KR) ..... 10-2004-0075405

(51) Int. Cl.
*H01J 17/49* (2006.01)

(52) U.S. Cl. ..... 313/582; 313/583; 313/584

(58) Field of Classification Search ..... 313/582–587
See application file for complete search history.

(56) References Cited

U.S. PATENT DOCUMENTS 6,400,078 B1 * 6/2002 Van Bommel et al. ..... 313/582

FOREIGN PATENT DOCUMENTS

JP 8-201784 8/1996
JP 2000243315 A * 9/2000
JP 2001-325889 11/2001
JP 2003-217463 7/2003

OTHER PUBLICATIONS

Patent Abstracts of Japan Publication No. 08-201784; Publication Date: Aug. 9, 1996; in the name of Inoue.
Patent Abstracts of Japan, Publication No. 2001-325889, dated Nov. 22, 2001, in the name of Kunio Yoshida.
Patent Abstracts of Japan, Publication No. 2003-217463, dated Jul. 31, 2003, in the name of Yoshio Watanabe.

* cited by examiner

*Primary Examiner*—Sikha Roy
*Assistant Examiner*—Anne M Hines
(74) *Attorney, Agent, or Firm*—Christie, Parker & Hale, LLP

(57) ABSTRACT

A plasma display panel is provided which includes a first panel and a second panel, a gas exhaust port and a gas exhaust tube. The first panel and the second panel are attached to each other such that discharge cells are formed and an image can be generated through a gas discharge within the discharge cells. The gas exhaust port is formed near at least one edge of the first panel and defines a passageway for communicating with the discharge cells. The gas exhaust tube is provided near an outer edge of the first panel in which the gas exhaust port is formed and communicates with the discharge cells via the gas exhaust port. The gas exhaust port and the gas exhaust tube are disposed such that the center lines of each are not aligned with each other.

7 Claims, 8 Drawing Sheets

PLASMA DISPLAY PANEL WITH GAS EXHAUST PORT

CROSS-REFERENCE TO RELATED APPLICATION

This application claims priority to and the benefit of Korean Patent Application No. 10-2004-0075405 filed in the Korean Intellectual Property Office on Sep. 21, 2004, the entire content of which is incorporated herein by reference.

BACKGROUND OF THE INVENTION

1. Field of the Invention

The embodiments of the present invention relate to a plasma display panel. More particularly, the embodiments of the present invention relate to a plasma display panel in which noise sources around a gas exhaust port and a gas exhaust tube can be effectively suppressed.

2. Description of the Related Art

Generally, a plasma display panel (PDP) is formed by combining a front panel with a rear panel to contain a discharge gas in the space between the panels. The front panel includes a front substrate, display electrodes formed on a rear surface of the front substrate, a dielectric layer covering the display electrodes, and a protective layer. The rear panel includes a rear substrate, address electrodes formed on a front surface of the rear substrate laid out in a direction crossing the display electrodes, a dielectric layer covering the address electrodes, barrier ribs formed on the dielectric layer and partitioning discharge cells and a phosphor layer formed on the discharge cells.

The PDP is driven by generating a sustain discharge and a reset discharge after an address discharge. If a sustain pulse is applied to the display electrode, an electric field is generated by the display electrodes in each discharge cell. Discharge gas is excited to a plasma state in a high energy level by this electric field and is then stabilized to a low energy level. During this process, an ultraviolet ray is generated. This ultraviolet ray excites the phosphor layer to a high energy level. The phosphor layer emits visible light while it is being stabilized to a lower energy level, and thus a desired image can be generated.

The PDP is provided with a gas exhaust port and a gas exhaust tube at one side of the rear substrate. The exhaust port and the gas exhaust tube are required to exhaust air remaining between the front and rear panels after combining the two panels and to seal the panels after injecting a discharge gas into an inner space between the two panels. To meet these requirements, the gas exhaust port and the gas exhaust tube are configured to define a passageway within the plasma display panel, at a terminal connection region, i.e., a dummy region provided between a display region showing images and an interconnection region for connecting electrode terminals to a connector.

When the PDP is driven, a natural frequency of the PDP and a driving frequency of the PDP that is applied to the display electrodes from a driving circuit may create resonance conditions. Noises and vibrations can be generated by the resonance. Such noises and vibrations may be further amplified while passing through the gas exhaust port and the gas exhaust tube that are formed in the rear substrate.

SUMMARY OF THE INVENTION

The embodiments of the invention provide a plasma display panel that effectively suppresses noise transmitted through a gas exhaust port and tube formed in a rear panel of the display.

An exemplary plasma display panel according to an embodiment of the present invention includes a first panel, a second panel, a gas exhaust port and a gas exhaust tube. The first panel and the second panel are attached to each other such that discharge cells are formed therebetween and an image is generated through a gas discharge within the discharge cells. The gas exhaust port is formed near at least one edge of the first panel and defines a passageway communicating with the discharge cells. The gas exhaust tube is provided on the outside of the first panel in which the gas exhaust port is formed and communicates with the discharge cells via the gas exhaust port. The gas exhaust port and the gas exhaust tube are disposed such that the center lines of each are not aligned with one another other. The gas exhaust port and the gas exhaust tube are disposed such that the center lines of each are substantially parallel to one another.

The gas exhaust tube may include a tap part, one end of which is wider than the other end with the wider end attached to the first panel, and a neck part that extends from the tap part in a direction perpendicular to the first panel. The neck part may have a diameter that is less than a diameter of the tap part.

In one embodiment, an imaginary planar cross-sectional area defined by an extension of a perimeter line of the gas exhaust tube and an imaginary planar cross-sectional area defined by an extension of a perimeter line of the neck part may partially overlap one another. The discharge cells may be in fluid communication with the tap part via the gas exhaust port. The neck part may be in fluid communication with the tap part. The imaginary planar cross-sectional area of the gas exhaust port and the imaginary planar cross-sectional area of the neck part may partially overlapped with each other.

In another embodiment, an imaginary planar cross-sectional area defined by an extension of a perimeter line of the gas exhaust port and an imaginary planar cross-sectional area defined by an extension of a perimeter line of the gas exhaust tube may not overlap. The discharge cells may be in fluid communication with the tap part via the gas exhaust port. The neck part may be in fluid communication with the tap part. The imaginary planar cross-sectional area of the gas exhaust port and the imaginary planar cross-sectional area of the neck part may not overlap each other.

In one embodiment, the gas exhaust port and the gas exhaust tube may be disposed such that center lines of each are parallel with one another. A center line of the gas exhaust port may align with the neck part of the gas exhaust tube or to the tap part of the gas exhaust tube.

Imaginary planar cross-sectional area defined by the extension of perimeter lines of the gas exhaust port and the gas exhaust tube neck part may be defined with a circular shape. A distance between a center line of the gas exhaust port and a center line of the gas exhaust tube neck part may be less than a sum of a radius of the imaginary planar cross-sectional area of the gas exhaust port and a radius of the imaginary planar cross-sectional area of the gas exhaust tube neck part.

Imaginary planar cross-sectional areas defined by extension lines of the gas exhaust port and the gas exhaust tube neck part may be defined with a circular shape, and a distance between a center line of the gas exhaust port and a center line of the gas exhaust tube neck part may be greater than or equal to a sum of a radius of the imaginary planar cross-sectional area of the gas exhaust port and a radius of the imaginary planar cross-sectional area of the gas exhaust tube neck part.

DETAILED DESCRIPTION

Figure 1:
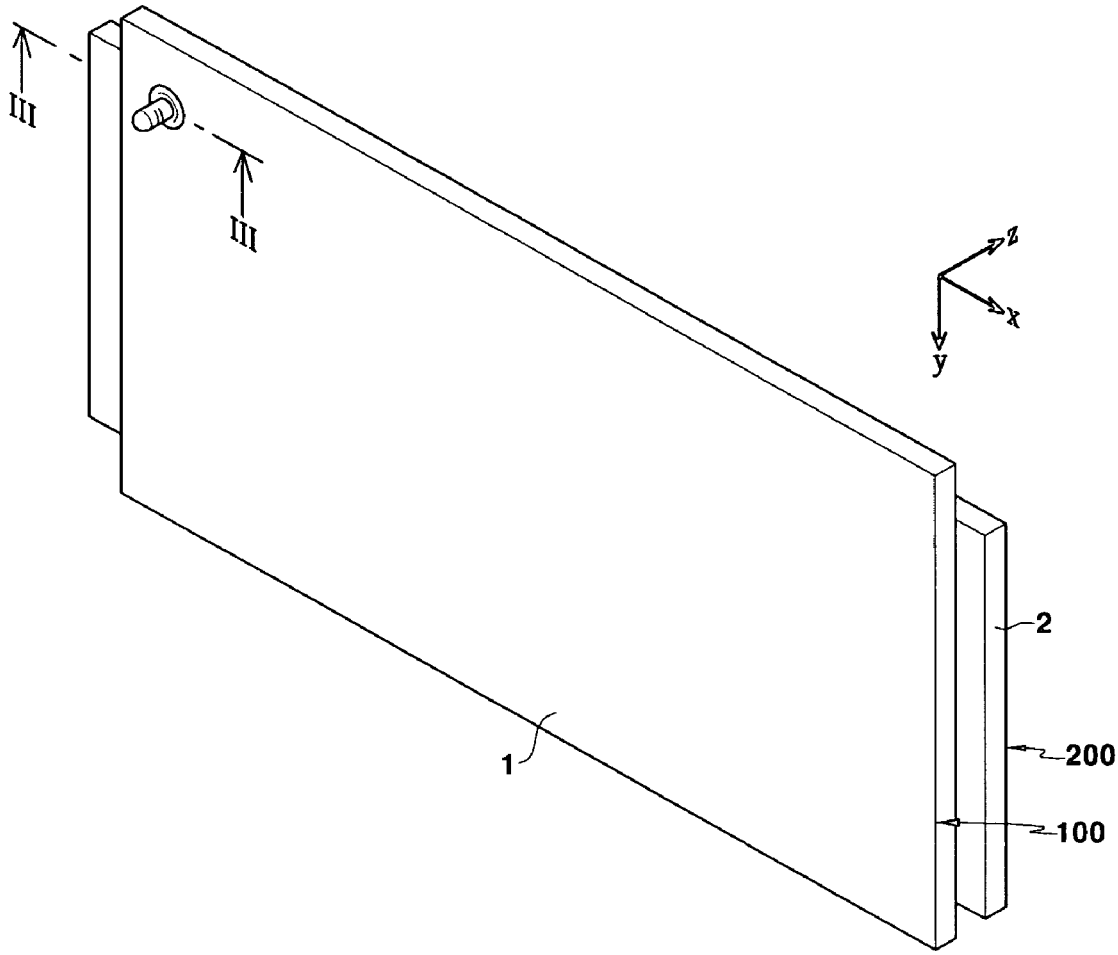
FIG. 1 is a perspective view of a plasma display panel, shown from a rear side, according to a first embodiment of the present invention.
Figure 2:
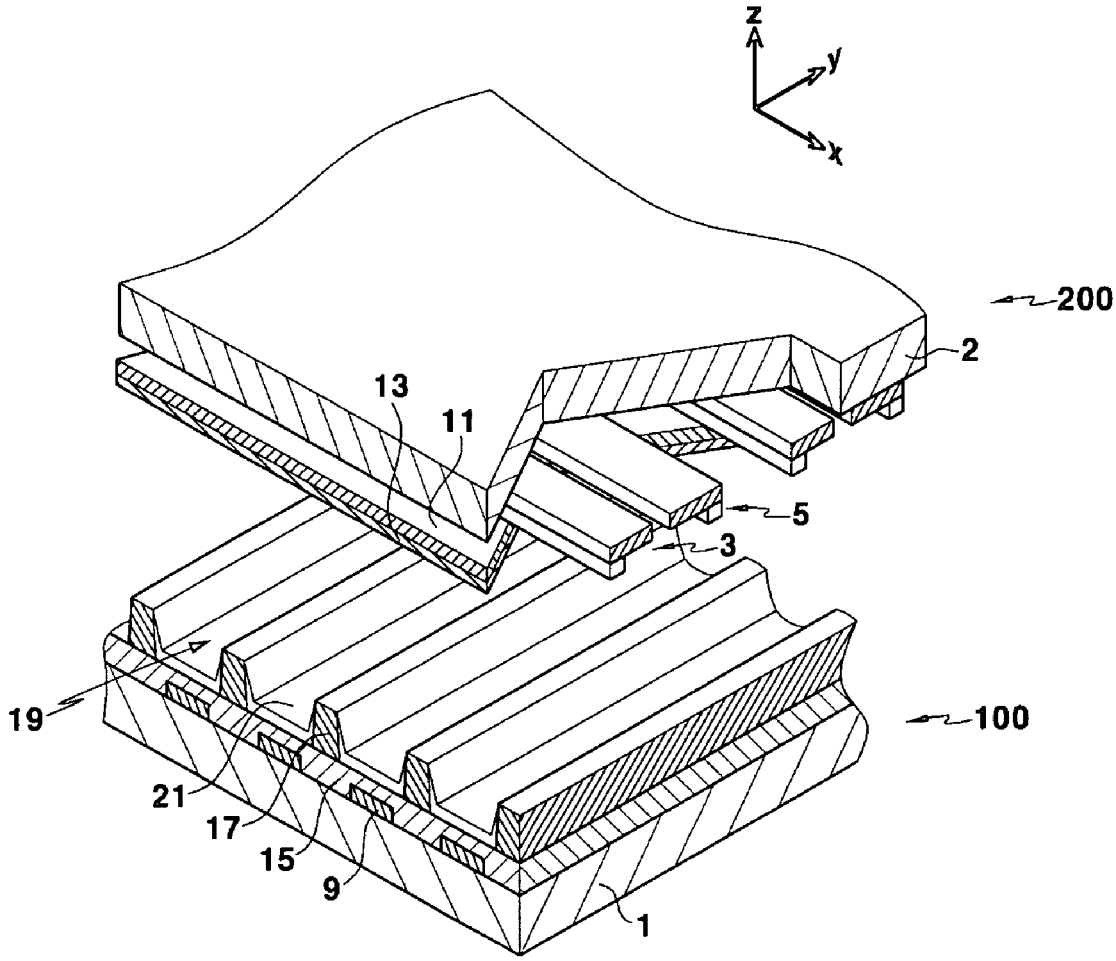
FIG. 2 is a partially exploded perspective view of the plasma display panel according to the first embodiment of the present invention.

Referring to FIGS. 1 and 2, a plasma display panel ("PDP") according to one embodiment includes discharge cells 19 to display images by using a gas discharge. The discharge cells 19 are formed by combining a first panel (hereinafter called a rear panel) 100 and a second panel (hereinafter called a front panel) 200 together. Because the height of the discharge cells 19 is very small in comparison to the thickness of the rear panel 100 and the front panel 200, the PDP shown in FIG. 1 appears to show the rear and front substrates 1 and 2 flush against one another.

In one embodiment, the PDP includes sustain electrodes 3 and scan electrodes 5, which form display electrodes. The display electrodes are formed on an inner surface of the front substrate 2 that forms the front panel 200. Address electrodes 9 are formed on an inner surface of the rear substrate 1 that forms the rear panel 100. The sustain electrodes 3 and the scan electrodes 5 are formed on the inner surface of the front substrate 2 and are covered with a dielectric layer 11 and a protective layer 13. The address electrodes 9 are formed on the inner surface of the rear substrate 1, and covered with a dielectric layer 15. Barrier ribs 17 are formed on the dielectric layer 15 to partition the discharge cells 19. A phosphor layer 21 is formed in each of the discharge cells 19. The discharge cells 19 may be filled with a mixture of inert gases such as Neon (Ne) and Xenon (Xe). Because the display electrodes and the address electrodes 9 are formed to cross each other on either side of corresponding discharge cells 19, the discharge cells 19 can be selected by application of specific address electrodes 9 and display electrodes. In one embodiment, the barrier ribs 17 are formed as stripes that are laid out in one direction (i.e., y-axis direction in FIG. 2). In another embodiment, the barrier ribs 17 may be formed in a matrix pattern in which they are laid out not only in the y-axis direction, but also in a x-axis direction, as is easily understood by a person of ordinary skill in the art.

When driving the PDP, an address discharge is generated during an address period by an address pulse applied to the address electrodes 9. A scan pulse is applied to the scan electrodes 5 to select the discharge cells 19 that are to be turned on. A sustain discharge is generated during a sustain period by a sustain pulse applied to the scan electrodes 5 and the sustain electrodes 3 to generate an image.

Figure 3:
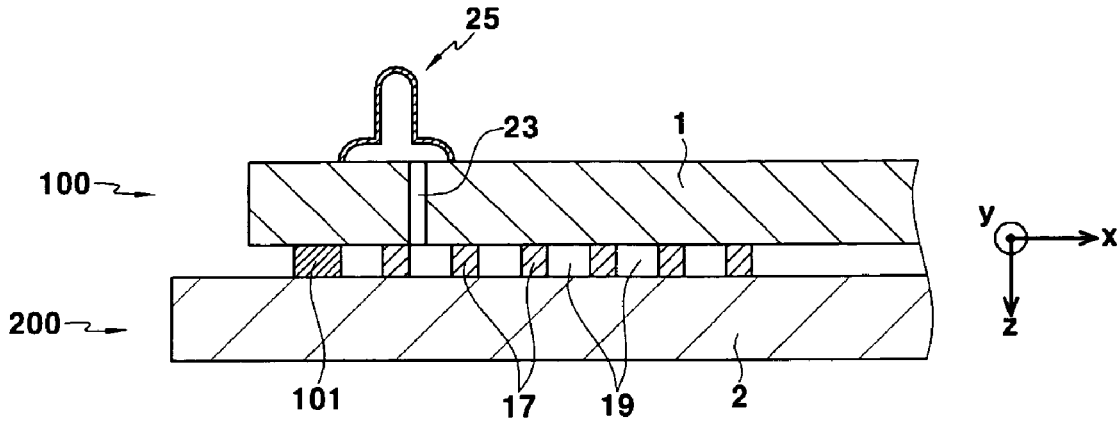
FIG. 3 is a cross-sectional view along a line III-III in FIG. 1.

During a manufacturing process of a PDP, air remains in the discharge cells 19 formed between the front substrate 2 and the rear substrate 1 after they are combined with each other. After exhausting the air in the discharge cells 19, discharge gas is injected into the space and an injection passageway is then sealed. To achieve this process, as shown in FIG. 3, a gas exhaust port 23 is formed in the rear panel 100 of the PDP. The gas exhaust port 23 may be formed near at least one edge of the rear substrate 1 and a gas exhaust tube 25 is attached around the gas exhaust port 23 so that the gas exhaust tube 25 communicates with the gas exhaust port 23.

The front substrate 2 and the rear substrate 1 are to each other near the edges of each substrate by a glass frit 101. The gas exhaust port 23 acts as a passageway connecting a discharge space, i.e., the discharge cells 19 formed between the front substrate 2 and the rear substrate 1, to the outside of the PDP. The gas exhaust tube 25 is attached to an outer surface of the rear substrate 1 to communicate with the gas exhaust port 23 and extends away from the rear substrate 1. An inner space of the PDP is in fluid communication with the outside to allow the exhaustion of air and injection of discharge gas. After finishing the injection of the discharge gas, the gas exhaust tube 25 is sealed so that the inner space of the PDP is isolated from the outside.

The gas exhaust port 23 and the gas exhaust tube 25 are formed with an orientation (i.e., the z-axis direction in FIG. 3) that is perpendicular to the rear substrate 1. The direction in which the gas exhaust port 23 is oriented is parallel with the orientation of the elongation of the gas exhaust tube 25. In one embodiment, cross-sectional shapes of the gas exhaust port 23 and the gas exhaust tube 25 have a circular shape. In another embodiment, the gas exhaust port 23 and the gas exhaust tube 25 may have various other cross-sectional shapes. Because, the gas exhaust port 23 is formed with a circular shape, breakage of the rear substrate 1 due to a concentration of stress on the gas exhaust port 23 by an external force can be effectively prevented. Because the gas exhaust tube 25 is formed with a circular shape, the gas exhaust tube 25 can effectively bear the pressure acting on it during the gas exhaustion process and the gas injection process.

Figure 4:
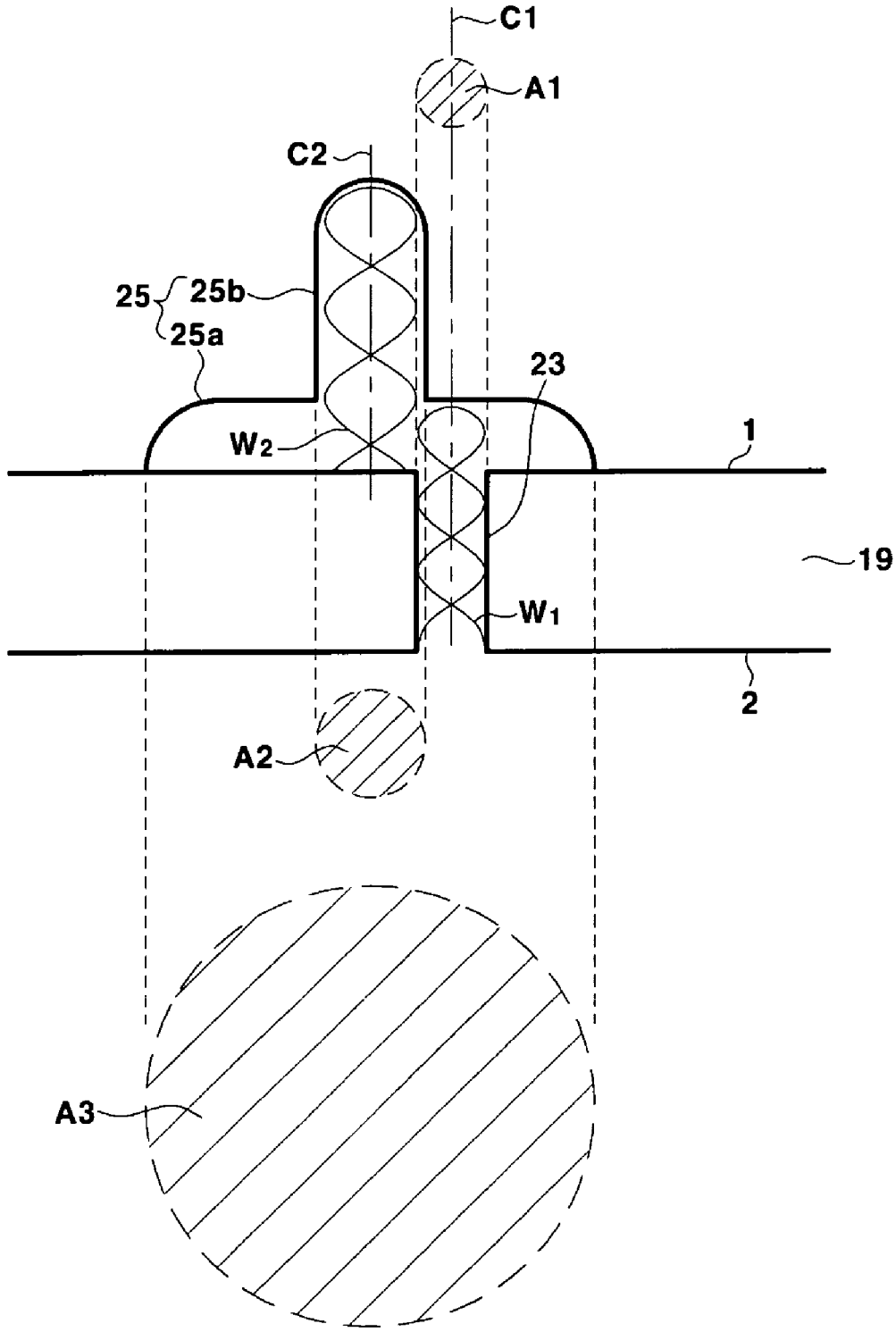
FIG. 4 is a schematic conceptual view illustrating noise waves generated while driving the plasma display panel according to the first embodiment of the present invention in a gas exhaust port formed in a rear substrate and a gas exhaust tube communicating with the gas exhaust port.

As shown in FIG. 4, because the gas exhaust port 23 and the gas exhaust tube 25 are each formed with a circular cross-sectional shape, each of them has a center line, C1 and C2, respectively. The center lines C1 and C2 are imaginary lines that pass through the centers of the cross-sectional circles defined by both the gas exhaust port 23 and the gas exhaust tube 25. As is easily understood by a person skilled in the art, if the gas exhaust port 23 or the gas exhaust tube 25 are formed as a polygon or an irregular closed curve, then a center line refers to imaginary lines passing through an approximate center of the overall region of a cross-section of the gas exhaust port 23 or the gas exhaust tube 25.

In one embodiment, center lines C1 and C2 of the gas exhaust port 23 and the gas exhaust tube 25 are not in line with each other, but instead deviate from each other. By orienting the center lines not to be in line with each other, noise wave W1 generated in the gas exhaust port 23 and noise wave W2 generated in the gas exhaust tube 25 have separate paths from each other during the driving of the PDP. Even though center lines C1 and C2 of the gas exhaust port 23 and the gas exhaust tube 25 do not line up with each other, a passageway connecting an inner space of the discharge cells 19, i.e., a discharge space, to the outside via the gas exhaust tube 25 and the gas exhaust port 23 is present. In this configuration, the gas exhaust tube 25 includes a tap part 25*a* and a neck part 25*b*.

The tap part 25*a* is formed such that the end attached to the rear substrate 1 is expanded to have a wider diameter, so that the tap part 25*a* can be attached to the rear substrate 1 while surrounding the opening of the gas exhaust port 23 that is formed in the rear panel 100. The neck part 25*b* is formed as an extension from the tap part 25*a* in a direction perpendicular to the rear panel 100. The neck part 25*b* forms a substantial portion of the gas exhaust tube 25. In one embodiment, the center line C2 of the gas exhaust tube 25 indicates a center line C2 of the neck part 25*b*. The neck part 25*b* is formed as an extension from the tap part 25*a* in a direction perpendicular to the rear substrate 1 with a diameter less than the diameter of the tap part 25*a*. The neck part 25*b* serves as a passageway to be connect to an external device during the gas exhaust process and the gas injection process. The neck part 25*b* is formed such that the noise wave W2 generated therein when driving the PDP does not align with the noise wave W1 generated in the gas exhaust port 23. Accordingly, propagation of noise generated in the gas exhaust port 23 to other portions of the PDP via the neck part 25*b* is suppressed.

Figure 5:
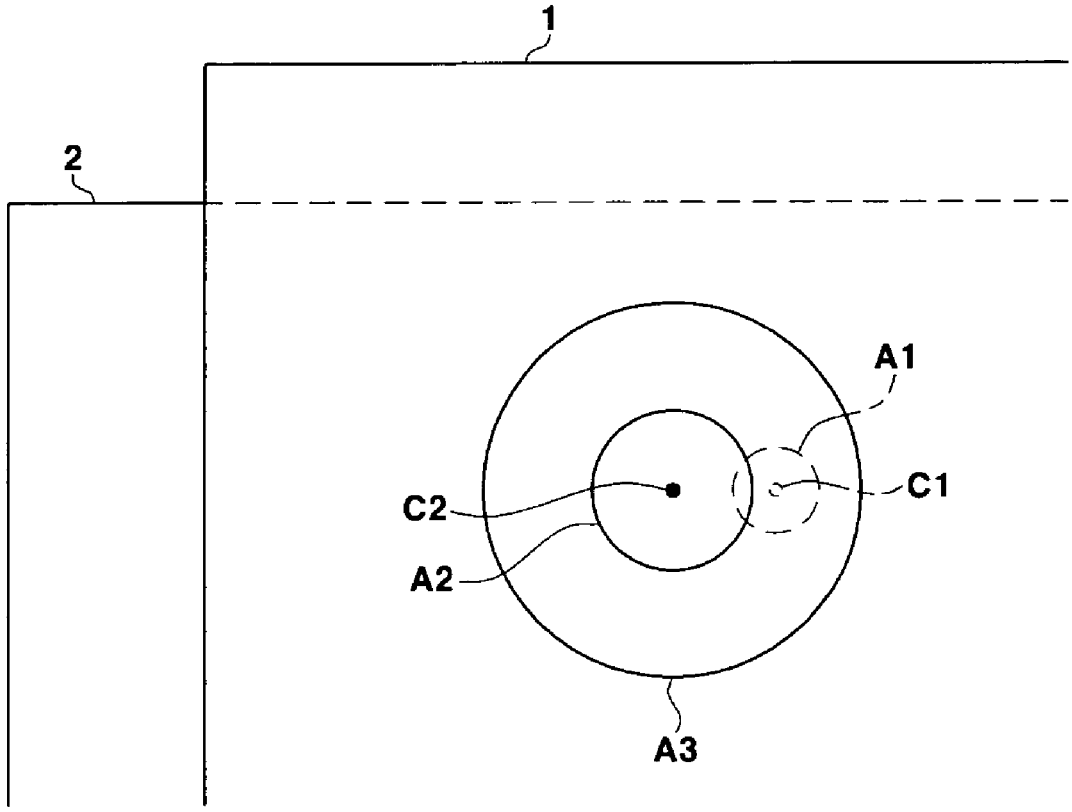
FIG. 5 is a schematic conceptual view illustrating an imaginary planar cross-sectional area defined by an extension of a perimeter line of a gas exhaust tube and an imaginary planar cross-sectional area defined by an extension of a perimeter line of a gas exhaust port that partially overlap, in a plasma display panel according to the first embodiment of the present invention.
Figure 6:
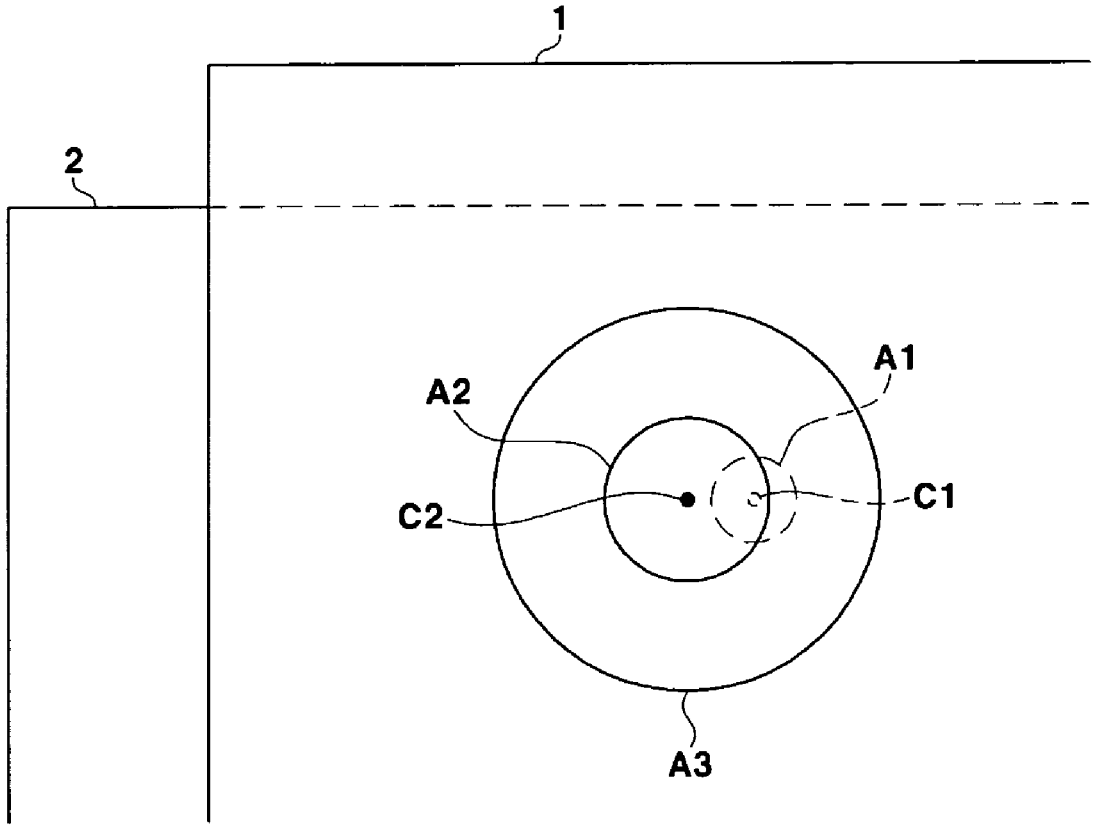
FIG. 6 is a schematic conceptual view illustrating an imaginary planar cross-sectional area defined by an extension of a perimeter line of a gas exhaust tube and an imaginary planar cross-sectional area formed by an extension of a perimeter line of a gas exhaust port that partially overlap, in a plasma display panel according to a second embodiment of the present invention.

Imaginary planar cross-sectional areas A1 and A2 are defined by extension of perimeter lines of the gas exhaust port 23 and the neck part 25*b* of the gas exhaust tube 25. These planar cross-sectional areas A1 and A2, as shown in FIGS. 4 to 6, are not centrally aligned with each other, in correspondence with the deviation of the above-mentioned center lines C1 and C2 from one another. In other words, a portion of these cross-sectional areas A1 and A2 overlap with each other.

The discharge cells 19 within the PDP are in fluid communication to the tap part 25*a* of the gas exhaust tube 25 via the gas exhaust port 23. The neck part 25*b* of the gas exhaust tube 25 is in fluid communication with the tap part 25*a*. The planar cross-sectional area A1 defined by the extension of the perimeter line of the gas exhaust port 23 and the planar cross-sectional area A2 defined by the extension of the perimeter line of the neck part 25*b* partially overlap with each other.

The center line C1 of the gas exhaust port 23 may be aligned with the tap part 25*a* or the neck part 25*b* of the gas exhaust tube 25. In the first embodiment shown in FIGS. 4 and 5, the center line C1 of the gas exhaust port 23 is aligned with the tap part 25*b* of the gas exhaust tube 25. On the other hand, in the second embodiment shown in FIG. 6, the center line C1 of the gas exhaust port 23 is partially aligned with the neck part 25*a* of the gas exhaust tube 25.

Overlapping between the structures is configured such that the noise wave W1 generated in the gas exhaust port 23 and the noise wave W2 generated in the neck part 25*b* partially overlap with each other, but do not completely overlap. As mentioned above, propagation of noise generated in the gas exhaust port 23 to other portions of the PDP via the neck part 25*b* is suppressed.

Figure 7:
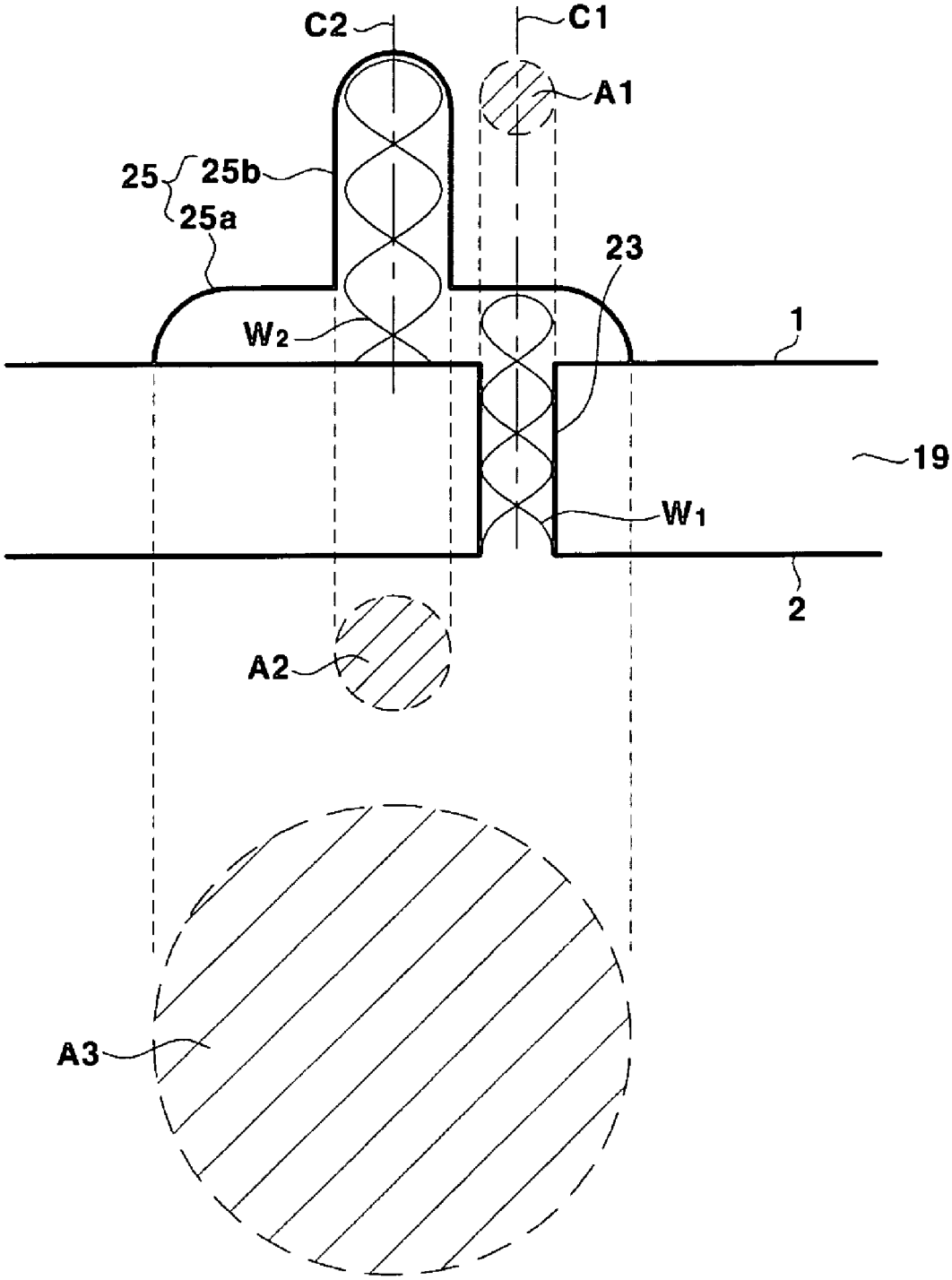
FIG. 7 is a schematic conceptual view illustrating noise waves generated in a gas exhaust port formed in a rear substrate and a gas exhaust tube communicating with the gas exhaust port, while driving a plasma display panel according to a third embodiment of the present invention.
Figure 8:
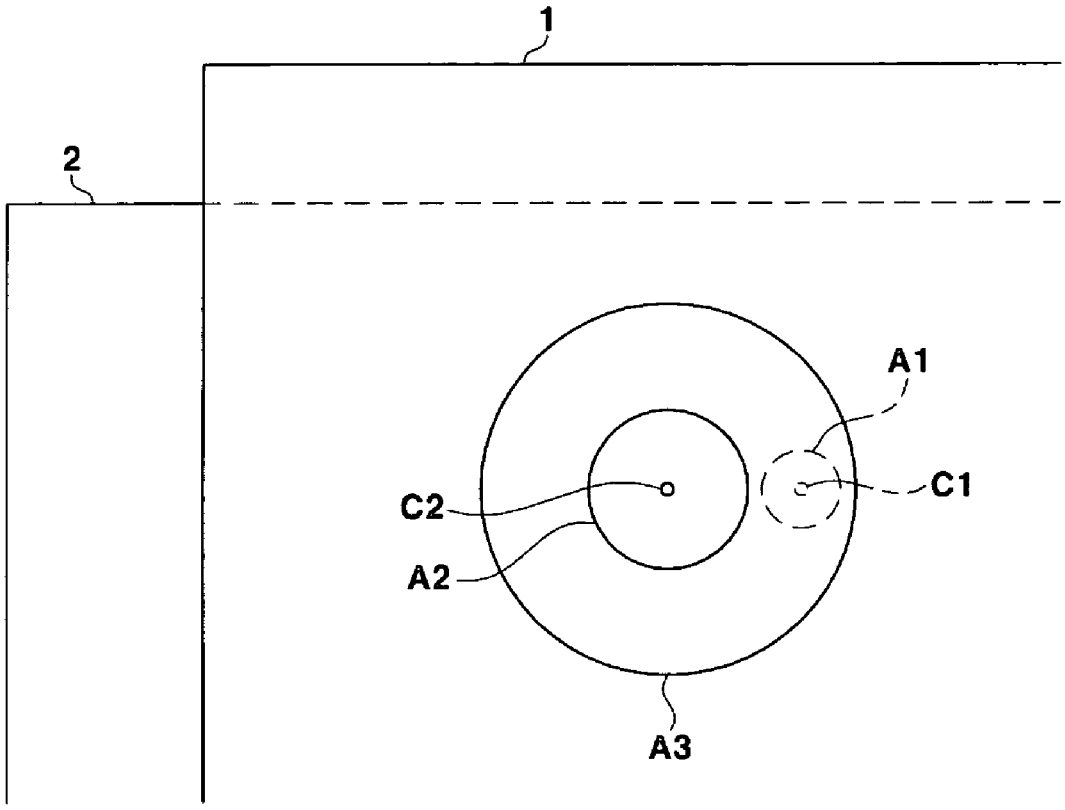
FIG. 8 is a schematic conceptual view illustrating an imaginary planar cross-sectional area defined by an extension of a perimeter line of a gas exhaust tube and an imaginary planar cross-sectional area defined by an extension of a perimeter line of a gas exhaust port that do not overlap, in a plasma display panel according to a third embodiment of the present invention.

In the third embodiment of the present invention, imaginary planar cross-sectional areas A1 and A2 of the gas exhaust port 23 and the neck part 25*b* of the gas exhaust tube 25, as shown in FIGS. 7 and 8, deviate from each other such that there is no alignment. In other words, the imaginary planar cross-sectional areas A1 and A2 are completely separated from each other and do not overlap with each other.

The discharge cells 19 within the PDP are connected to the tap part 25*a* of the gas exhaust tube 25 via the gas exhaust port 23. The neck part 25*b* of the gas exhaust tube 25 is connected to the tap part 25*a*. The imaginary planar cross-sectional areas A1 defined by the extension of the perimeter line of the gas exhaust port 23 and the imaginary planar cross-sectional area A2 formed by the extension of the perimeter line of the neck part 25*b* are completely spaced apart from each other, without any overlapping. The cross-sectional area A1 may remain within an imaginary planar cross-sectional area A3 defined by an extension of the perimeter line of the tap part 25*a*.

In the third embodiment, similar to the first embodiment, the center line C1 of the gas exhaust port 23 is aligned with the tap part 25*b* of the gas exhaust tube 25. However, in the third embodiment, a distance between the center line C1 of the gas exhaust port 23 and the center line C2 of the neck part 25*b* of the gas exhaust tube 25 is greater than or equal to a sum of a radius of the planar cross-sectional area A1 of the gas exhaust port 23 and a radius of the planar cross-sectional area A2 of the neck part 25*b* of the gas exhaust tube 25. In the second embodiment, a distance between the center line C1 of the gas exhaust port 23 and the center line C2 of the neck part 25*b* of the gas exhaust tube 25 is formed to be less than a sum of a radius of the planar cross-sectional area A1 of the gas exhaust port 23 and a radius of the planar cross-sectional area A2 of the neck part 25*b* of the gas exhaust tube 25.

The noise wave W1 generated in the gas exhaust port 23 and the noise wave W2 generated in the neck part 25*b* are completely separated. The propagation of noise generated in the gas exhaust port 23 to other portions of the PDP via the neck part 25*b* may be more effectively suppressed in comparison to the configurations of FIGS. 4 to 6.

Because the noise wave W1 generated in the gas exhaust port 23 and the noise wave W2 generated in the neck part 25*b* of the gas exhaust tube 25, as mentioned above, are partially or completely separated, noise echo effects generated by the gas exhaust port 23 and the tap part 25*a* of the gas exhaust tube 25 can be substantially decreased. Such a decrease of the noise echo effects can substantially decrease the amplification of noise caused by resonance at a natural frequency of the PDP and a driving frequency that is generated when driving the PDP. In one embodiment, noise can be decreased by minimizing the noise echo effects, rather than directly decreasing the noise generated around the gas exhaust port 23 and the gas exhaust tube 25.

In one embodiment, the gas exhaust port is formed in the rear panel, and the gas exhaust tube is formed around the gas exhaust port. In addition, according to some embodiments of the present invention, the center line of the gas exhaust tube and the center line of the gas exhaust port are formed to be deviated from each other, or the imaginary planar cross-sectional area defined by the extension of the perimeter line of the gas exhaust tube and the imaginary planar cross-sectional area defined by the extension of the perimeter line of the gas exhaust port are disposed to deviate from each other. The noise waves generated in the gas exhaust port and the noise waves generated in the gas exhaust tube deviate from each other and propagation of the noise generated in the gas exhaust port to other portions of the PDP via the gas exhaust tube can be suppressed.

In one embodiment, the neck part and the gas exhaust port are disposed to deviate from each other. The tap part of the gas exhaust tube is disposed between the neck part and gas exhaust port. The tap part of the gas exhaust tube can prevent the tube from acting as a generating source for noise echo effects between the neck part and the gas exhaust port. The amplification of noise due to a resonance of an inherent frequency of the PDP and a driving frequency generated while driving the PDP, i.e., a noise source, can be effectively suppressed.

While this invention has been described in connection with exemplary embodiments, it is to be understood that the invention is not limited to the disclosed exemplary embodiments, but, on the contrary, is intended to cover various modifications and equivalent arrangements included within the spirit and scope of the appended claims.

What is claimed is:

1. A plasma display panel comprising:

a first panel and a second panel attached to each other such that discharge cells are formed for generating an image through a gas discharge within the discharge cells;

a gas exhaust port formed near at least one edge of the first panel, the gas exhaust port defining a passageway communicating with the discharge cells; and a gas exhaust tube provided on an outside of the first panel, the gas exhaust tube communicating with the discharge cells via the gas exhaust port, wherein the gas exhaust port has a gas exhaust port axial center line through the passageway and the gas exhaust tube has a gas exhaust tube axial center line, the gas exhaust port axial center line and the gas exhaust tube axial center line being substantially parallel to one another but not in line with one another, wherein an imaginary planar cross-sectional area perpendicular to the gas exhaust tube axial center line is defined by a perimeter line of the gas exhaust tube, wherein an imaginary planar cross-sectional area perpendicular to the gas exhaust port axial center line is defined by a perimeter line of the gas exhaust port, and wherein the perimeter line of the gas exhaust tube and the perimeter line of the gas exhaust port overlap.

2. The plasma display panel of claim 1, wherein the gas exhaust tube comprises:

a tap part having a first end that is wider than a second end, the first end attached to the first panel; and a neck part formed as an extension from the tap part in a direction perpendicular to the first panel, the neck part having a diameter less than a diameter of the tap part.

3. The plasma display panel of claim 2, wherein:

the discharge cells are in communication with the tap part via the gas exhaust port; and the neck part is in communication with the tap part.

4. The plasma display panel of claim 2, wherein the gas exhaust port axial center line is aligned with the tap part of the gas exhaust tube.

5. The plasma display panel of claim 1, wherein the gas exhaust port axial center line is within the imaginary planar cross-sectional area defined by the perimeter line of the gas exhaust tube.

6. The plasma display panel of claim 1, wherein the gas exhaust port and the gas exhaust tube are disposed such that the gas exhaust port axial center line and gas exhaust tube axial center line are perpendicular to the first panel.

7. A plasma display panel comprising:

a first panel and a second panel attached to each other such that discharge cells are formed for generating an image through a gas discharge within the discharge cells;

a gas exhaust port formed near at least one edge of the first panel, the gas exhaust port defining a passageway communicating with the discharge cells; and a gas exhaust tube provided on an outside of the first panel, the gas exhaust tube communicating with the discharge cells via the gas exhaust port, wherein the gas exhaust port has a gas exhaust port axial center line through the passageway and the gas exhaust tube has a gas exhaust tube axial center line, the gas exhaust port axial center line and the gas exhaust tube axial center line being substantially parallel to one another but not in line with one another, wherein the gas exhaust tube comprises:

a tap part having a first end that is wider than a second end, the first end attached to the first panel; and a neck part formed as an extension from the tap part in a direction perpendicular to the first panel, the neck part having a diameter less than a diameter of the tap part, wherein the gas exhaust port axial center line is aligned with the tap part of the gas exhaust tube, and wherein an imaginary planar cross-sectional area perpendicular to the gas exhaust port axial center line defined by an extension of a perimeter line of the gas exhaust port and an imaginary planar cross-sectional area perpendicular to a gas exhaust tube axial neck part center line defined by an extension of perimeter line of the gas exhaust tube neck part are each defined with a circular shape and a distance between the gas exhaust port axial center line and the gas exhaust tube axial neck part center line is less than a sum of a radius of the imaginary planar cross-sectional area of the gas exhaust port and a radius of the imaginary planar cross-sectional area of the gas exhaust tube neck part.

* * * * *